US005823713A

United States Patent [19]

Biran

[11] Patent Number: 5,823,713

[45] **Date of Patent: *Oct. 20, 1998**

[54] SCUBA DIVING APPARATUS WITH DEPTH CONTROL

[76] Inventor: Daniel Biran, 10 Brody Street, Ramat Aviv 69 056 Tel Aviv, Israel

[ * ] Notice: The terminal 22 months of this patent has been disclaimed.

[21] Appl. No.: 176,994

[22] Filed: Jan. 3, 1994

[51] Int. Cl.[6] ..... B63C 11/02

[52] U.S. Cl. ..... 405/186; 441/92

[58] Field of Search ..... 405/185, 186; 441/92, 106, 114–119; 137/81.1, 81.2, 565.13

[56] References Cited

U.S. PATENT DOCUMENTS

| | | | |
|---|---|---|---|
| 3,605,418 | 9/1971 | Levine | 405/186 |
| 3,820,348 | 6/1974 | Fast | 408/186 |
| 3,898,705 | 8/1975 | Schuler | 405/186 |
| 4,324,507 | 4/1982 | Harrah | 405/186 |
| 4,379,656 | 4/1983 | Darling | 405/186 |
| 4,396,032 | 8/1983 | Duchesne et al. | 137/81.2 |
| 4,527,582 | 7/1985 | Buckle et al. | 137/81.2 |
| 4,529,333 | 7/1985 | Robinette | 405/186 |
| 4,601,609 | 7/1986 | Hyde | 405/186 |
| 4,681,552 | 7/1987 | Courtney | 441/115 |
| 4,720,281 | 1/1988 | Matzuoka | 405/186 |
| 4,986,700 | 1/1991 | Takeda | 405/186 |

*Primary Examiner*—Michael Powell Buiz
*Assistant Examiner*—Frederick L. Lagman
*Attorney, Agent, or Firm*—Keck, Mahin & Cate

[57] ABSTRACT

Scuba diving apparatus includes a buoyancy compensator attachable to a diver, and a depth control device for sensing the depth of the diver and for automatically increasing the buoyancy of the buoyancy compensator when the diver is submerged at a predetermined depth in the water, to thereby prevent the diver from exceeding the predetermined depth.

17 Claims, 4 Drawing Sheets

SCUBA DIVING APPARATUS WITH DEPTH CONTROL

RELATED APPLICATION

This application is related to my copending patent application Ser. No. 08/176,977, filed the same date as this application, for: Scuba Diving Apparatus with Rate-of-Ascent Control now abandoned.

FIELD AND BACKGROUND OF THE INVENTION

The present invention relates to scuba (derived from "Self-Contained Underwater-Breathing Apparatus") diving apparatus, and particularly to such apparatus which automatically prevents the diver using it from exceeding a predetermined depth.

Scuba diving apparatus generally includes a buoyancy compensator attachable to the diver to enable the diver to operate at any desired depth. In one type of such diving apparatus, the buoyancy compensator is an inflatable device, e.g., a jacket worn by the diver or a pillow attached to the diver, such that the change in volume of the buoyancy compensator changes the buoyancy of the diver. Another type of buoyancy compensator includes a constant volume tank into which water is admitted or expelled to change the buoyancy of the diver. In both types of devices, there is a danger that the diver may unwittingly exceed a predetermined depth such as to result in a serious danger to the diver's health or safety.

OBJECTS AND BRIEF SUMMARY OF THE INVENTION

An object of the present invention is to provide scuba diving apparatus which minimizes the foregoing danger.

According to the present invention, there is provided scuba diving apparatus comprising: a buoyancy compensator attachable to a diver, and a depth control device for sensing the depth of the diver and for automatically increasing the buoyancy of the buoyancy compensator when the diver is submerged at a predetermined depth in the water, to thereby prevent the diver from exceeding the predetermined depth.

The invention is particularly useful in the type of diving apparatus including an inflatable buoyancy device, particularly an inflatable buoyancy jacket, and is therefore described below with respect to this application.

According to further features in the described preferred embodiments, the apparatus further includes a pressurized gas tank attachable to the diver, and a conduit between the inflatable device and the pressurized gas tank and controlled by the depth control device to automatically introduce gas into the inflatable device, and thereby to further inflate it, when the diver is at the predetermined depth.

According to further features in the described preferred embodiments, the depth control device includes a housing attachable to the diver so as to be submerged in the water with the diver. The housing has an inlet connectible to the pressurized gas tank, an outlet connected to the inflatable device, a control passageway between the inlet and outlet, and a displaceable member normally urged to close the passageway but automatically displaced to open the passageway upon sensing the predetermined depth. The displaceable member is normally urged to close the passageway by a spring acting on one side of the displaceable member, the pressure of the water acting on the opposite side of the displaceable member to open the passageway when the housing is submerged at the predetermined depth.

According to further preferred features, the housing includes manually adjustable means for presetting the force applied by the spring to the displaceable member, and thereby for preselecting the predetermined depth.

According to still further preferred features, the housing further includes a manual actuator for manually moving the displaceable member against the force of the spring to open the passageway.

Several embodiments of the invention are described below wherein the displaceable member include one, two and three membranes; and further embodiments are described wherein the displaceable member is a piston.

Additional features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
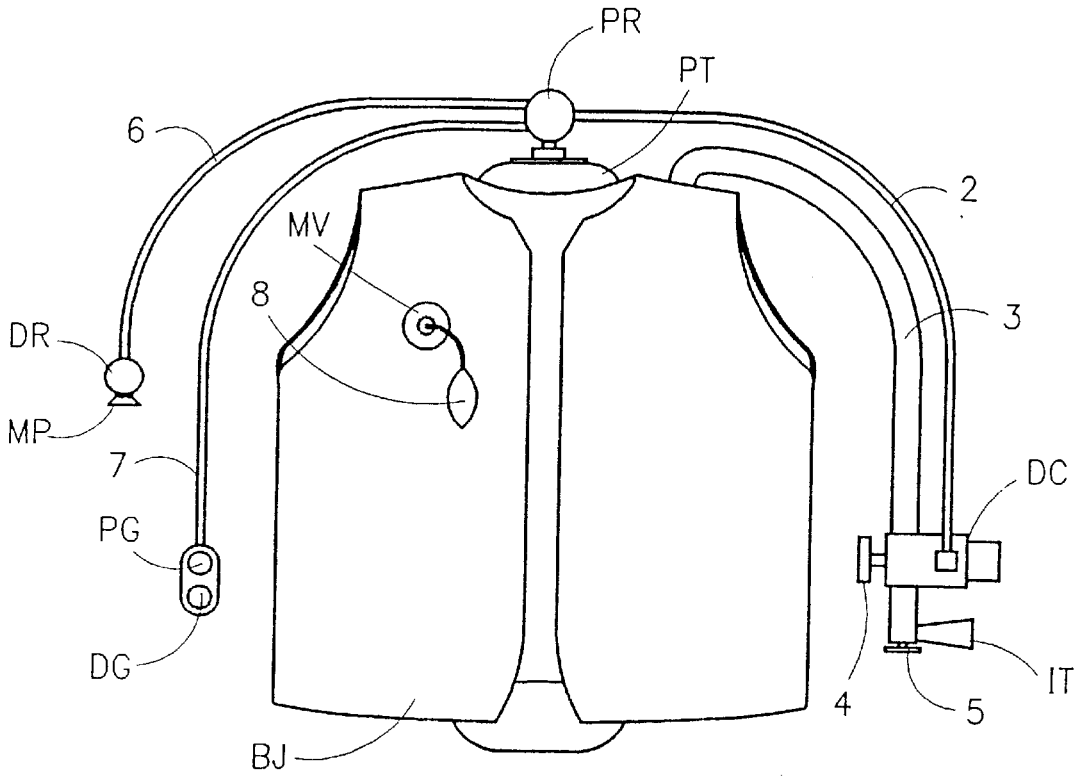
FIG. 1 illustrates one form of scuba diving apparatus constructed in accordance with the present invention.

Overall Construction (FIG. 1)

The scuba diving apparatus illustrated in FIG. 1 comprises a buoyancy compensator in the form of a buoyancy jacket BJ which is to be worn by the diver. It includes inflatable chambers to adjust the buoyancy of the diver, and thereby to permit the diver to operate at different depths. Attached to the buoyance jacket BJ is a pressurized air tank PT which supplies air to inflate the buoyancy jacket BJ via a pressure regulator PR and conduits 2 and 3. The latter conduits include a depth control device DC provided with manual controls 4, 5, and an inflator tube IT permitting the diver to manually control the degree of inflation of the buoyancy jacket. Manual control 4 is a button which is manually depressed by the diver in order to introduce air into the inflatable buoyancy jacket BJ, and manual control 5 is a second button depressed by the diver in order to discharge air from the buoyancy jacket BJ, or to inflate it by blowing through inflator tube IT.

The depth control unit DC, including the inflator tube IT and the manual controls 4, 5, are more particularly illustrated in FIG. 2, described below.

The pressure tank PT also supplies breathing air to the diver via a conduit 6, demand regulator DR, and mouthpiece MP. A pressure gauge PG connected to the pressure tank PT via the pressure regulator PR enables the diver to observe the pressure state of the tank. The pressure gauge PG also carries a depth gauge DG enabling the diver to observe the depth of the diver.

The buoyancy jacket BJ illustrated in FIG. 1 further includes a manual valve MV which may be operated by the diver by pulling a pull cord 8 in order to discharge air from the buoyancy jacket.

The diving equipment insofar as described above is well known, and therefore further details of its construction and operation are not set forth herein.

According to the present invention, the depth control device DC in FIG. 1 is constructed to sense the depth of the diver, and automatically to control the air introduced from the pressure tank PT into the buoyancy jacket BJ in order to increase the buoyancy of the diver when the diver reaches a predetermined depth, thereby preventing the diver from exceeding the predetermined depth which may represent a hazard to the diver's health or safety. FIG. 2 more particularly illustrates the construction of the depth control unit DC of FIG. 1 for automatically increasing the buoyancy of the diver when at the predetermined maximum depth. FIG. 2 also illustrates the inflator tube IT which enables the diver to blow air into the buoyancy jacket in order to increase its buoyancy.

FIGS. 3–7 illustrate different constructions of depth control units in accordance with the invention for automatically increasing the buoyancy of the diver when at the predetermined maximum depth.

Figure 2:
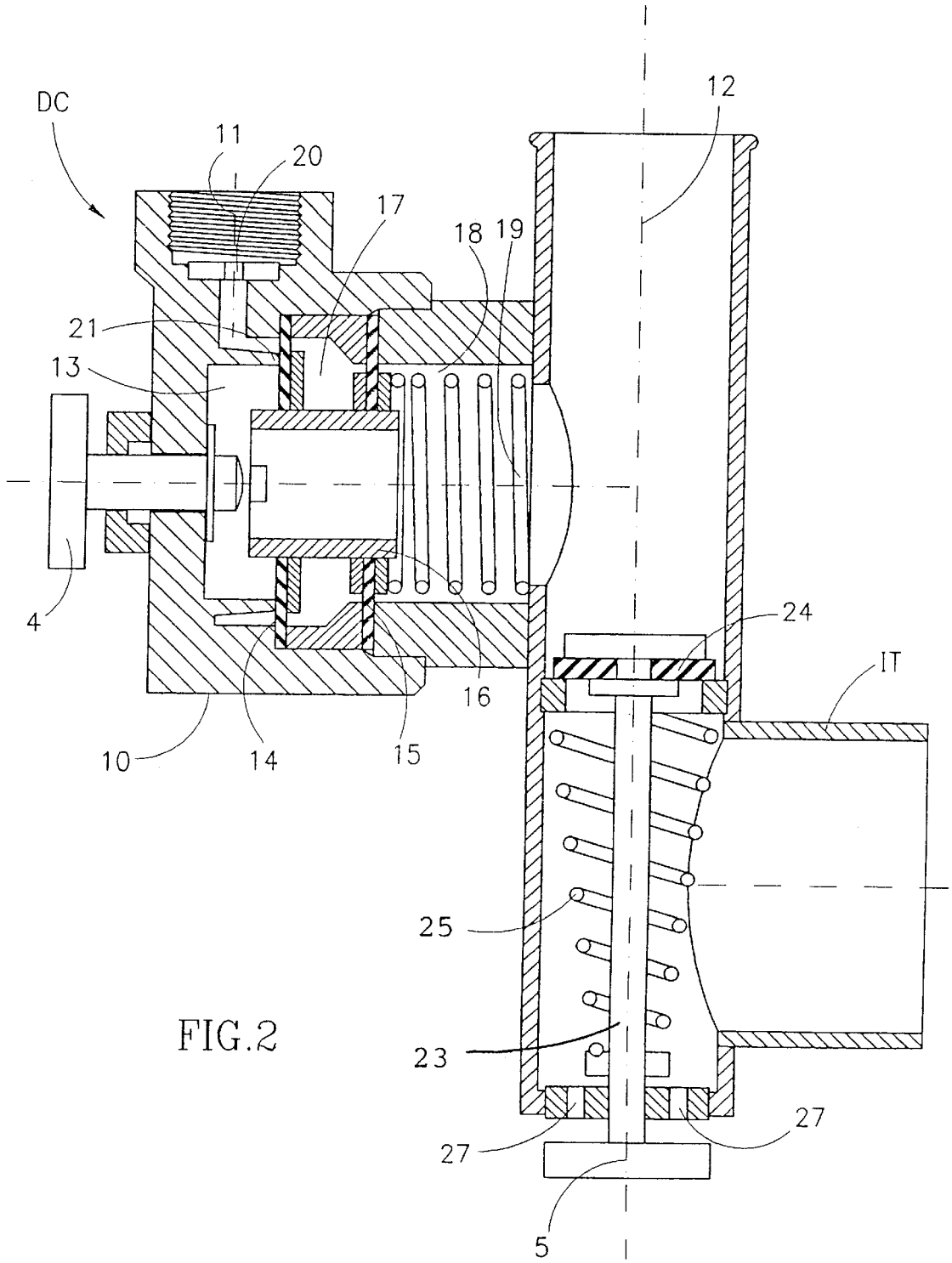
FIG. 2 is a longitudinal sectional view illustrating the inflator of FIG. 1 incorporating one form of depth-control device in accordance with the present invention.

The Depth Control Unit DC and Inflator Tube IT (FIG. 2)

The depth control unit DC including inflator tube IT shown in FIG. 2 includes a housing 10 formed with an inlet 11 connectible to the pressure tank PT via the pressure regulator PR and conduit 2. Housing 10 further includes an outlet 12 connectible to the buoyancy jacket BJ via conduit 3. A control passageway 13 within housing 10 connects the inlet 11 to the outlet 12. Passageway 13 is controlled by a displaceable member, membrane 14 in the embodiment of FIG. 2, which is normally urged to close passageway 13, but which is automatically displaced to open the passageway upon sensing a predetermined depth at the inlet 11, to thereby further inflate the buoyancy jacket BJ. Button 4 may also be depressed to open the passageway to further inflate the buoyancy jacket. Button 5, on the other hand, may be manually depressed to deflate the buoyancy jacket, or to permit the diver to blow air into the buoyancy jacket via inflator tube IT, which would carry a mouthpiece (not shown) for this purpose.

In the depth control unit DC illustrated in FIG. 2, the displaceable member which opens the passageway to the buoyancy jacket BJ includes, not only membrane 14, but a second membrane 15 secured in parallel spaced relation to membrane 14 by a hollow stem 16. The outer edges of the two membranes are secured to housing 10 so that the annular space between the two membranes defines a sealed reference chamber 17. The space within the hollow stem 16 is open to an outlet chamber 18 which communicates via outlet 12 with the buoyancy jacket BJ. A coil spring 19 is located within the outlet chamber 18.

Inlet 11 communicates with passageway 13 via a flow restrictor orifice 20 and a valve seat 21 normally engaged by membrane 14 under the force of spring 19. Spring 19 bears against membrane 15 which is coupled to membrane 14 by the hollow stem 16. Thus, in the normal condition of the depth control device DC illustrated in FIG. 2, membrane 14 is urged to block the flow from inlet 11 via passageway 13 to the outlet 12.

The pressure at the inlet 11 connected to the pressure reducer PR (FIG. 1) is the reduced pressure from the pressure tank PT plus the water pressure at the depth of the diver. So long as the diver is above the predetermined maximum depth, the pressure at inlet 11 will be insufficient, as compared to the force of spring 19 and the pressure in the buoyancy jacket BJ, to unseat membrane 14 from valve 21. However, should the diver reach the predetermined maximum depth, the pressure at the inlet 11 will be sufficient to unseat membrane 14 from seat 21, whereby a quantity of air flow from the pressure tank PT into the buoyancy jacket BJ via inlet 11, valve seat 21, passageway 13, the space within the hollow stem 16, outlet chamber 18 and outlet 12. This flow of air into the buoyancy jacket BJ will further inflate the buoyancy jacket, and thereby prevent the diver from exceeding the predetermined depth.

Diaphragm 14 may also be moved to manually unseat it from valve seat 21 by manual button 4 which bears against the hollow stem 16. This will also further inflate the buoyancy jacket BJ to cause the diver to ascend.

The descent of the diver may be controlled by manual button 5. This button is connected by a stem 23 to a valve member 24 which is urged to a closed position by another spring 25. However, when button 5 is depressed, valve member 24 unseats from valve seat 26 to open a passageway from the buoyancy jacket BJ to the atmosphere via openings 27 formed in housing 10.

The diver may also inflate the buoyancy jacket BJ by depressing button 5 and at the same time blowing into the inflator tube IT. Depressing button 5 moves valve member 24 to its open position and permits the diver to blow air via the inflator tube IT into the buoyancy jacket BJ. Spring 25 can be of a relatively light construction so that the diver can also blow air into the buoyancy jacket without depressing button 5.

Figure 3:
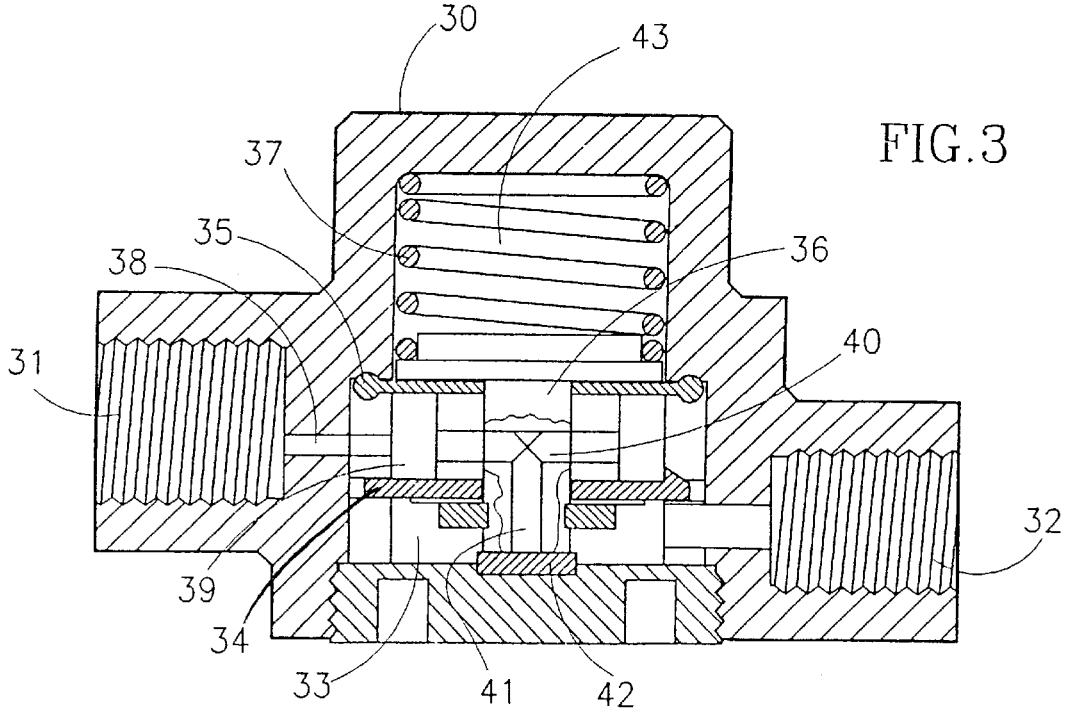
FIGS. 3–7 are longitudinal sectional views illustrating five further forms of depth control devices constructed in accordance with the present invention.

The Depth Control Device of FIG. 3

FIG. 3 illustrates another construction of depth control device which can be used for sensing the maximum depth and for automatically connecting the pressure tank PT to the buoyancy jacket BJ to automatically further inflate the latter when the predetermined depth is sensed. The depth control unit illustrated in FIG. 3 also includes a two-membrane arrangement, but of a slightly different construction and operation.

Thus, the depth control unit illustrated in FIG. 3 includes a housing 30 having an inlet 31 connectible via conduit 2 (FIG. 1) and pressure reducer PR to the pressure tank PT, and an outlet 32 connectible to the buoyancy jacket BJ and communicating with the inlet 31 via a control passageway 33. The displaceable member in the construction illustrated in FIG. 3 includes a first diaphragam 34 connected to a second membrane 35 by means of a stem 36. The two-membrane assembly is urged to close passageway 33 by a coiled spring 37.

In the construction illustrated in FIG. 3, housing 30 is also provided with a restrictor orifice 38, but in this case this orifice establishes communication between the inlet 31 and the space 39 between the two membranes 34, 35. In addition, stem 36 connecting the two membranes is formed with a radial bore 40 communicating with an axial bore 41 and extending therefrom to the end of the stem received within passageway 33, where it is engageable with a resilient pad 42. Thus, the end of stem 36 engaging pad 42 serves as a valve member carried by membrane 34, and the pad 42 serves as a valve seat. Chamber 43 defined by the outer surface of membrane 35 and housing 30 and in which spring 37 is located, serves as a sealed reference chamber.

It will be seen that so long as the diver is above the maximum predetermined depth, the pressure at the inlet 31 will be insufficient to move membrane 34 to unseat its valve member (namely the tip of its stem 36) from valve seat 42, thereby blocking the introduction of pressurized air from the pressure tank PT via the inlet 31 to the buoyancy jacket BJ via the outlet 32. However, when the diver is at the maximum predetermined depth, the pressure at the inlet 31 will be sufficient to overcome spring 37, and thereby to unseat the valve member from valve seat 42 and to automatically introduce air, via the inlet 31 and outlet 32, into the buoyancy jacket BJ.

In the construction illustrated in FIG. 3, since the pressure at the inlet 31 is applied to both the membranes 34 and 35, the force tending to open the valve will be that corresponding to the cross-sectional area of the axial bore 41. Accordingly, spring 37 may be a relatively light spring as compared to the construction illustrated in FIG. 2.

Figure 4:
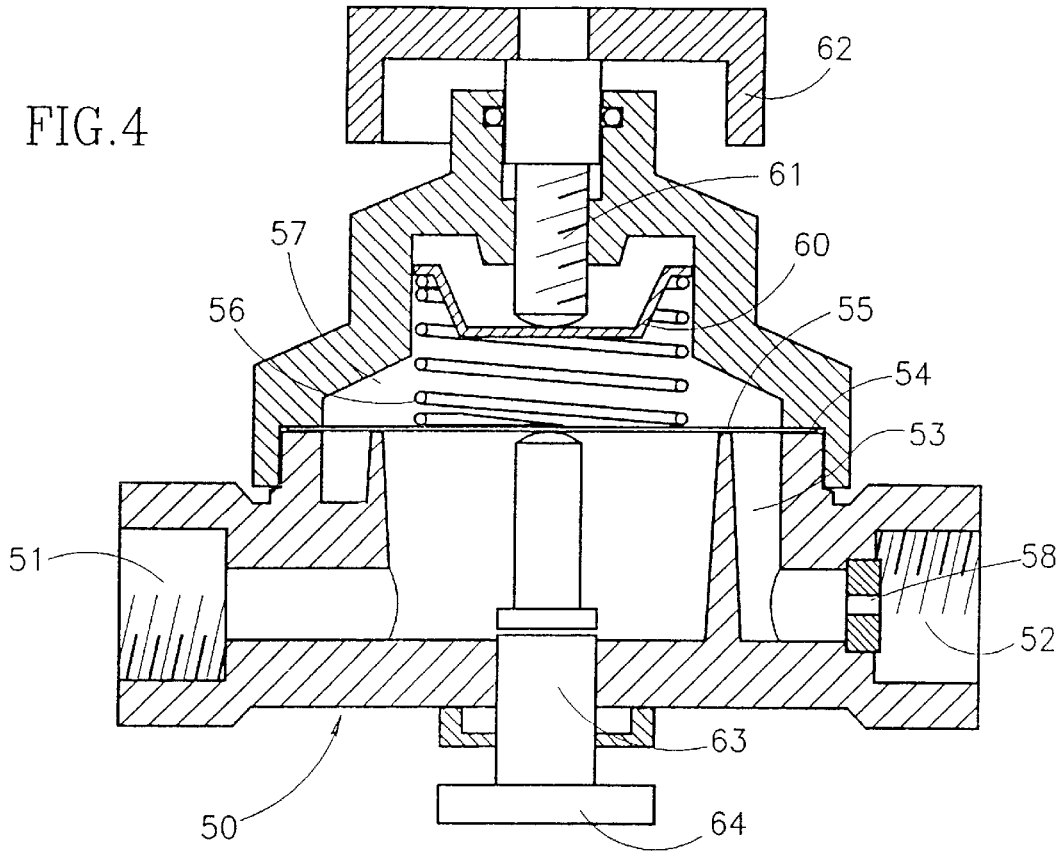

The Depth Control Device of FIG. 4

FIG. 4 illustrates a single-membrane type of depth control device which may be used for sensing the maximum depth and for automatically connecting the pressure tank PT to the buoyancy jacket BJ in response thereto.

The depth control device illustrated in FIG. 4 also includes a housing 50 having an inlet 51 connectible to the pressure tank PT, an outlet 52 connectible to the buoyancy jacket BJ, and a control passageway 53 which is normally closed by a displaceable membrane 54, but which is automatically opened upon sensing the predetermined maximum depth. In this case, the membrane 54 is urged to its closed position on valve seat 55 by a coiled spring 56 located within a sealed reference chamber 57; also the flow restrictor orifice 58 is provided adjacent to the outlet 52, rather than adjacent the inlet as in the previous constructions.

A further difference in the construction illustrated in FIG. 4 is that the force applied by the coil spring 56, tending to close membrane 54 against valve seat 55, may be adjusted, to thereby preset the maximum depth. For this purpose, the end of coil spring 56 opposite to that bearing against membrane 54 is provided with a collar 60 engaged by an adjustment screw 61 having a knob 62 externally of the housing 50. By rotating knob 62 in one direction or the other, the screw 61 may be threaded more or less into chamber 57 carrying the coil spring 56 to vary the compression of the coil spring, and therefore the force applied by it to the membrane 54. By thus presetting the force of spring 56, the force required to unseat membrane 54 from valve seat 55 may be preset, to preset the maximum depth at which the device will operate to open the passageway from the inlet 51 to the outlet 52, and thereby to increase the buoyancy of the buoyancy jacket BJ.

The device illustrated in FIG. 4 also permits the diver to manually open the passageway to increase the buoyancy of the buoyancy jacket. For this purpose, the device includes a stem 63 slidable through an opening in the housing 50 and having an enlarged head 64 exernally of the housing. The inner end of stem 63 is engageable with membrane 54, such that when the diver presses the enlarged head 64 inwardly, the stem unseats the membrane from valve seat 55, thereby connecting inlet 51 to outlet 52 to introduce air from the pressure tank PT into the buoyancy jacket BJ.

Figure 5:
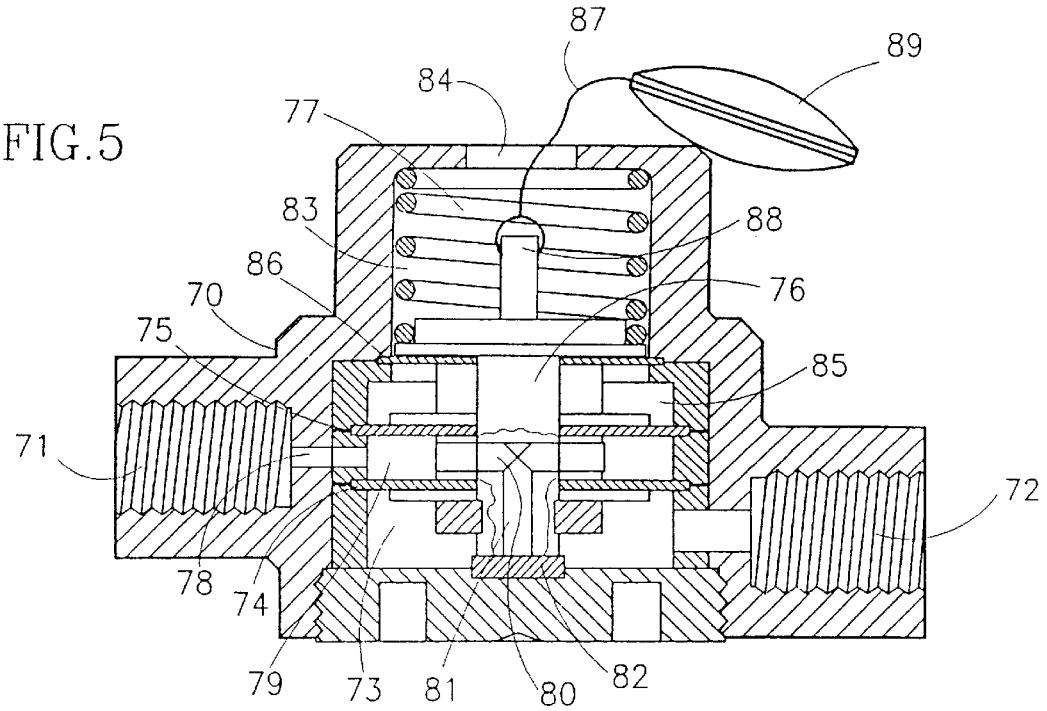

The Depth Control Device of FIG. 5

FIG. 5 illustrates a depth control device somewhat similar to that of FIG. 3 but including three membranes, rather than the two membranes in FIG. 3. Thus, the device illustrated in FIG. 5 includes a housing 70 having an inlet 71 connectible to an outlet 72 via a passageway 73 controlled by two membranes 74 and 75 connected together by a stem 76, similar to membranes 34, 35 and stem 36 in FIG. 3. The device of FIG. 5 further includes a coil spring 77 urging the device to its closed condition, and a restrictor orifice 78 connecting the inlet 71 to chamber 79 between the two membranes 74, 75. Also as in FIG. 3, chamber 79 between the two membranes communicates with passageway 73 via a radial bore 80 and an axial bore 81 formed in stem 76. The outer end of the stem seats against resilient pad 82 which serves as a valve seat for the respective end of the stem.

In the construction illustrated in FIG. 5, however, the chamber 83 containing the coil spring 77 is not sealed, but rather is open to the outside ambient via an opening 84. Instead, the sealed reference chamber, corresponding to chamber 43 in FIG. 3, is defined by the space 85 between membrane 75 and a third membrane 86 also secured to stem 76. membrane 76 is of smaller cross-sectional area than the other two membranes 74, 75.

The device illustrated in FIG. 5 further includes a pull cord 87 passing through opening 84 in the housing 70. The inner end of cord 87 is secured to an eye 88 carried by stem 76, whereas the outer end of the cord is secured to a knob 89 graspable by the diver.

It will be seen that in the construction illustrated in FIG. 5, the unbalanced ambient pressure at the inlet 71 and also at the opening 84 in housing 70 acts only on the differential area of the upper membrane 86 and the lower membrane 74, and therefore the spring 77 may be a relatively light one. It will also be seen that the diver may manually open the valve by grasping knob 89 and pulling on cord 87, thereby unseating the end of stem 76 from resilient pad 82, to open the passageway between the inlet 71 and the outlet 72.

In all other repects, the construction illustrated in FIG. 5 operates the same as described above particularly with reference to FIG. 3.

Figure 6:
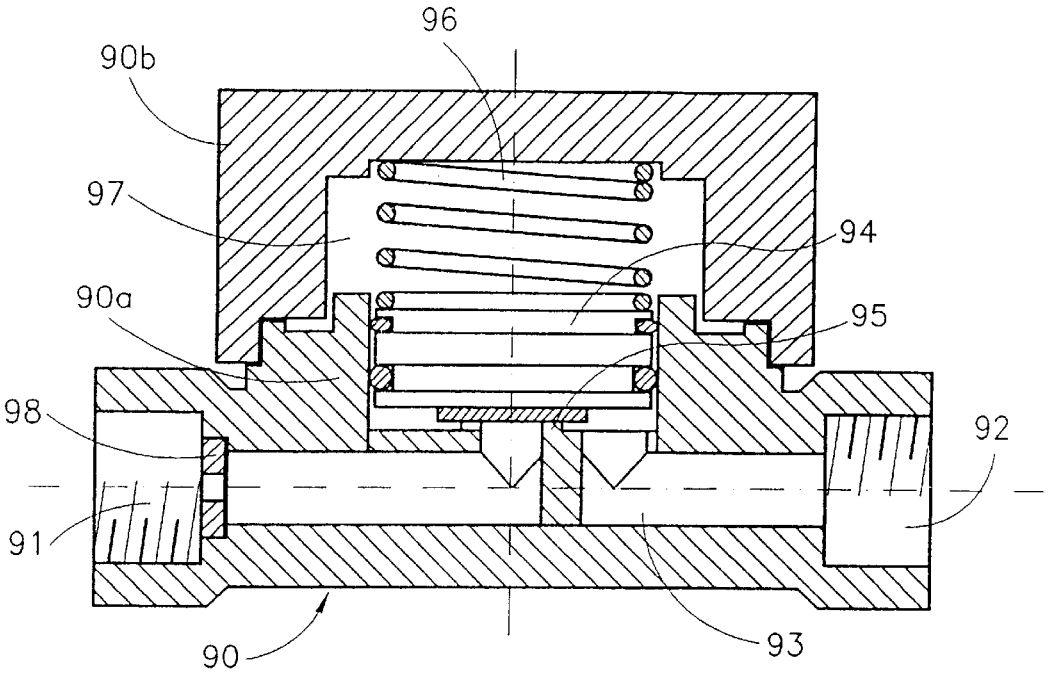
Figure 7:
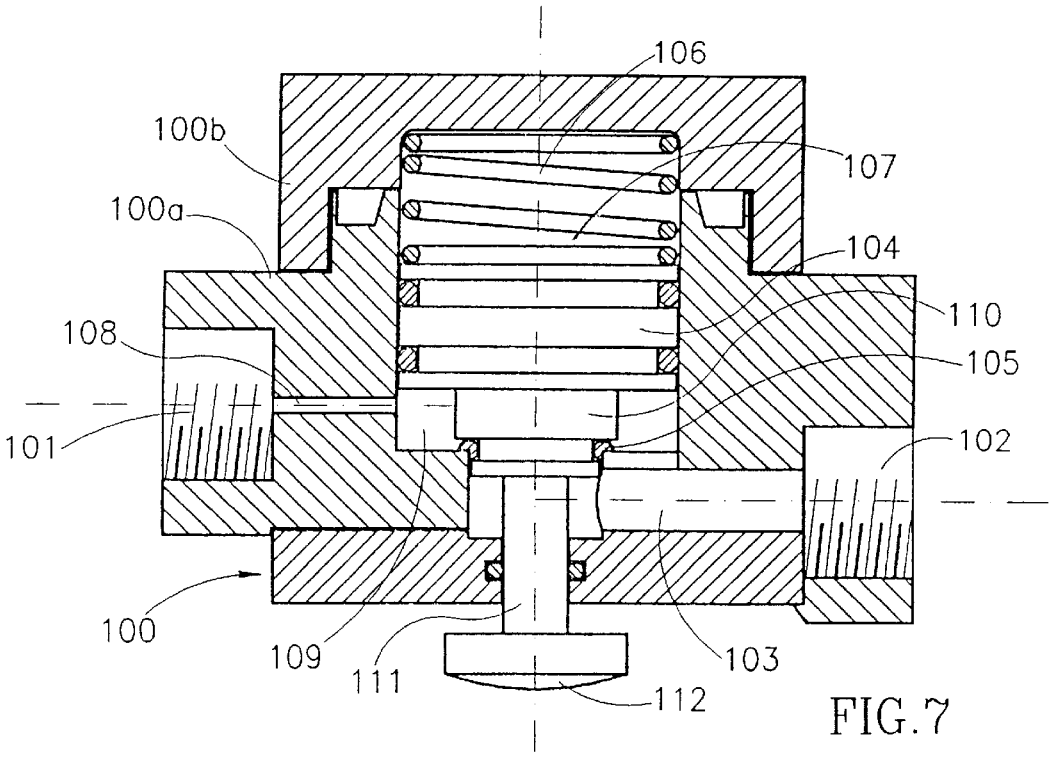

The Depth Control Devices of FIGS. 6 and 7

FIGS. 6 and 7 illustrate depth control devices operating according to the same principles as described above but including a piston-type displaceable member, rather than a membrane-type displaceable member.

Thus, the device illustrated in FIG. 6 includes a housing 90 having an inlet 91 connectible to the pressure tank PT (FIG. 1), an outlet 92 connectible to the buoyancy jacket BJ, and a passageway 93 connecting the inlet to the outlet and controlled by a displaceable piston 94. Piston 94 is normally urged to close a valve seat 95 by a coil spring 96 received within a sealed reference chamber 97. A flow restrictor orifice 98 is provided between the inlet 91 and the valve seat 95.

The device illustrated in FIG. 6 operates in substantially the same manner as described above with respect to FIG. 4. Thus, when the maximum depth is sensed, the pressure at inlet 91 overcomes the force of spring 96 to unseat piston 94 from valve seat 95, thereby establishing communication between the pressure tank PT (FIG. 1) and the buoyancy jacket BJ via inlet 91, passageway 93 and outlet 92.

The device illustrated in FIG. 6 can also be adjusted to preset the maximum depth. This is done by threading housing section **90*b* more or less with respect to housing section 90*a* in order to vary the compression of spring 96, and thereby to vary the force applied by the spring to piston 94**.

FIG. 7 illustrates a construction similar to that of FIG. 6. Thus, the device of FIG. 7 also includes a housing 100 having an inlet 101 and an outlet 102 connected by a control passageway 103. The displaceable member controlling passageway 103 is in the form of piston 104 seatable on a valve seat 105 by a coil spring 106 within a sealed reference chamber 107. A flow restrictor orifice 108 connects the inlet 101 to an inlet chamber 109. In this case, however, the inlet chamber is defined by a second piston 110. The assembly including the two pistons 104 and 110 further includes a stem 111 passing through housing section **100*a* and terminating in an enlarged button 112**.

It will thus be seen that upon sensing the maximum pressure depth, the piston assembly will move against spring 106 to unseat from valve seat 105, and thereby to open the passageway from the inlet 101 to the outlet 102 to introduce pressurized gas into the buoyancy jacket BJ, and thus to terminate any further descent and to start an ascent. The force of spring 106 which determines the maximum depth can be preset by threading cap 100*b* more or less into housing section 100*a* to thereby vary the compressor force applied by spring 106 against the piston assembly. The diver may also manually increase the buoyancy by depressing button 112, which also unseats the piston assembly to open inlet 101 from the pressure tank PT to the outlet 102 to the buoyancy jacket BJ.

Many other variations may be made. For example, the depth may be sensed by an electrical sensor. Also, the sensor may be a pilot valve controlling a main valve which controls the air flow.

What is claimed is:

1. Scuba apparatus, comprising:

a depth control device for sensing depth of a diver and for automatically increasing buoyancy of a buoyancy compensator when the diver is submerged at a predetermined depth in water, to thereby prevent the diver from exceeding said predetermined depth, wherein said depth control device includes a housing having an inlet connectable to a pressurized gas tank, an outlet connected to an inflatable buoyancy device, a control passageway between said inlet and outlet, and a displaceable member normally urged to close said passageway but automatically displaced to open said passageway upon sensing said predetermined depth.

2. The apparatus according to claim 1, therein said displaceable member is automatically urged to close said passageway by a spring acting on one side of said displaceable member, the pressure of the water in which the housing is submerged acting on the opposite side of the displaceable member to open said passageway automatically when the housing is submerged at said predetermined depth.

3. The apparatus according to claim 2, wherein said housing includes manually adjustable means for presetting the force applied by the spring to said displaceable member, and thereby for preselecting said predetermined depth.

4. The apparatus according to claim 3, wherein said manually adjustable means includes a pin threaded into the housing and bearing against a collar at one end of said spring.

5. The apparatus according to claim 2, wherein said housing further includes a manual actuator for manually moving the displaceable member against the force of said spring to manually open said passageway.

6. The apparatus according to claim 5, wherein said manual actuator includes a stem slidable through an opening in said housing and having an outer end engageable by the diver and an inner end engageable with said opposite side of the displaceable member to displace said displaceable member against said spring when the stem is pressed into the housing by the diver.

7. The apparatus according to claim 5, wherein said manual actuator comprises a pull cord passing through said housing and having an inner end connected to said displaceable member, and an outer end carrying a knob graspable by the diver.

8. The apparatus according to claim 2, wherein said displaceable member includes a membrane.

9. The apparatus according to claim 8, wherein said displaceable member comprises a pair of diaphgrams secured to said housing in parallel spaced relation.

10. The apparatus according to claim 9, wherein said pair of spaced membranes define a sealed reference chamber between them and are secured together by a hollow stem communicating with said outlet, said spring being located in an outlet chamber communicating with said outlet.

11. The apparatus according to claim 9, wherein said membranes are secured together by a stem, one of said membranes carrying a valve member movable with respect to a valve seat for opening or closing said passageway, the other of said membranes defining with said housing a sealed reference chamber, said spring being located in said sealed reference chamber and bearing against said other side of the membrane; said inlet communicating with the space between said pair of membranes.

12. The apparatus according to claim 8, wherein said displaceable member comprises first, second and third membranes secured to said housing in parallel spaced relation by a stem; said second membrane defining with said first membrane an inlet chamber communicating with said inlet, and also communicating with said valve member by a bore in said stem; one side of said third membrane defining with said second membrane a sealed reference chamber, and the opposite side of said third membrane defining with said housing a spring chamber containing said spring and communicating with the water pressure externally of the housing.

13. The apparatus according to claim 12, wherein said third membrane is of smaller effective cross-sectional area than said second membrane.

14. The apparatus according to claim 2, wherein said displaceable member includes a piston movable within the housing.

15. The apparatus according to claim 14, wherein one side of said piston defines with said housing a sealed reference chamber in which said spring is located.

16. The apparatus according to claim 15, wherein the other side of said piston carries a valve member movable to open and close said passageway.

17. The apparatus according to claim 1, wherein said apparatus further includes an inflator tube permitting the diver to blow air into said buoyancy compensator.

* * * * *